US005077850A

United States Patent [19]

Brubaker

[11] Patent Number: 5,077,850

[45] Date of Patent: Jan. 7, 1992

[54] MULTIPLE UTILITY DEVICE FOR A KEY RING

[76] Inventor: William K. Brubaker, 23327 Edsel Ford, St. Clair Shores, Mich. 48080

[21] Appl. No.: 720,254

[22] Filed: Jun. 24, 1991

[51] Int. Cl.[5] ..... B67B 7/44; B25F 1/00

[52] U.S. Cl. ..... 7/151; 7/170; 7/165; 24/3 K; 248/301; 248/339; 248/914; 81/3.09; 224/163; D8/34; D3/64

[58] Field of Search ..... 7/151, 165, 167, 169, 7/170, 105; 81/3.09, 3.07, 3.4, 3.55; D8/18, 33, 34, 40, 43; D3/61, 63, 64; 24/3 K, 3 R, 129 A, 329, 598.5; 224/163, 268; 248/301, 339, 914, 304

[56] References Cited

U.S. PATENT DOCUMENTS

| | | | |
|---|---|---|---|
| 376,825 | 1/1888 | Kent | 7/105 |
| 4,210,302 | 7/1980 | Serkez | 248/914 |
| 4,384,390 | 5/1983 | Hayakawa | 7/151 |
| 4,658,455 | 4/1987 | Skillern | 7/105 |

FOREIGN PATENT DOCUMENTS

| | | | |
|---|---|---|---|
| 0024245 | 1/1931 | Australia | 7/151 |
| 1188808 | 3/1959 | France | 248/339 |
| 1265989 | 5/1961 | France | 248/339 |

*Primary Examiner*—Roscoe V. Parker
*Attorney, Agent, or Firm*—Peter D. Keefe

[57] ABSTRACT

A utility device for a key ring which serves a plurality utilities, including key ring anchorage, bottle cap opener, screw driver, hook and item holder with respect to another object. The utility device has a generally C-shaped structure having a central open space defined by interior walls of a main member, two cross members and two opposed tabs. A hole is provided in the C-shaped structure to permit a key ring (key chain and the like) to be connected thereto. The distance between facing ends of the tabs is preselected to permit the ends to cooperate so that a user can leverably act on a bottle cap to open a capped bottle. One external corner of the C-shaped structure is preferred to be provided with a flat, beveled blade edge to serve as a screwdriver blade. It is further preferred for a portion of the interior walls to have a predetermined contour which servies to assist hooking of the C-shaped structure onto an object. In this regard, a second object, such as a purse, may now, in turn, be hooked to the C-shaped structure to thereby suspend it from the first object.

15 Claims, 2 Drawing Sheets

MULTIPLE UTILITY DEVICE FOR A KEY RING

BACKGROUND OF THE INVENTION

1. Field of the Invention

The present invention relates to key rings (including key chains and the like), and more particularly to a utility device for primary use in connection with a key ring. Still more particularly, the present invention relates to a utility device which serves, inter alia, as an anchor for a key ring, a bottle cap opener, a screw driver and a hook for holding itself and for holding other items, such as a lady's purse, with respect to another object.

2. Description of the Prior Art

In the prior art there are many items that serve in the capacity of a key ring. Most of these items are simply display devices which serve an emblematic purpose, such as to identify a vacation spot or a car name plate. These devices serve no other purpose than to provide anchorage for the key ring so that the keys may be more easily found and used. Those devices which serve another purpose besides anchorage, such as a match holder or a whistle, generally have a specfic, limited utility.

Accordingly what is needed in the art is a device for connection with a key ring which has multiple utilities.

SUMMARY OF THE INVENTION

The present invention is a utility device for a key ring which serves a plurality of utilities, including key ring anchorage, bottle cap opener, screw driver, hook and item holder with respect to another object.

The present invention is a utility device having a generally C-shaped structure having a central open space defined by interior walls of a main member, two cross members and two opposed tabs. A hole is provided in the C-shaped structure to permit a key ring (key chain and the like) to be connected thereto. The distance between facing ends of the tabs is preselected to permit the ends to cooperate so that a user can leverably act on a bottle cap to open a capped bottle. One external corner of the C-shaped structure is preferred to be provided with a flat, beveled blade edge to serve as a screwdriver blade. It is further preferred for a portion of the interior walls to have a predetermined contour which serves to assist hooking of the C-shaped structure onto an object. In this regard, a second object, such as a purse, may now, in turn, be hooked to the C-shaped structure to thereby suspend it from the first object.

Accordingly, it is an object of the present invention to provide a utility device for a key ring which provides anchorage for one or more keys attached to the key ring.

It is an additional object of the present invention to provide a utility device for a key ring which is of a C-shape that permits it to be hooked easily onto an object.

It is another object of the present invention to provide a utility device for a key ring which may be hooked onto a first object with a second object, in turn, being hooked onto the utility device.

It is a further object of the present invention to provide a utility device for a key ring which is able to open capped bottles.

It is yet a further object of the present invention to provide a utility device for a key ring which is able to turn screwdriver slotted screws, bolts and the like.

It is still another object of the present invention to provide a utility device for a key ring having a C-shape which has a central opening that includes inside wall portions that are contoured to facilitate hooking the utility device onto a first object while holding a second object thereto.

These, and additional objects, advantages, features and benefits of the present invention will become apparent from the following specification.

DETAILED DESCRIPTION OF THE PREFERRED EMBODIMENT

Figure 1:
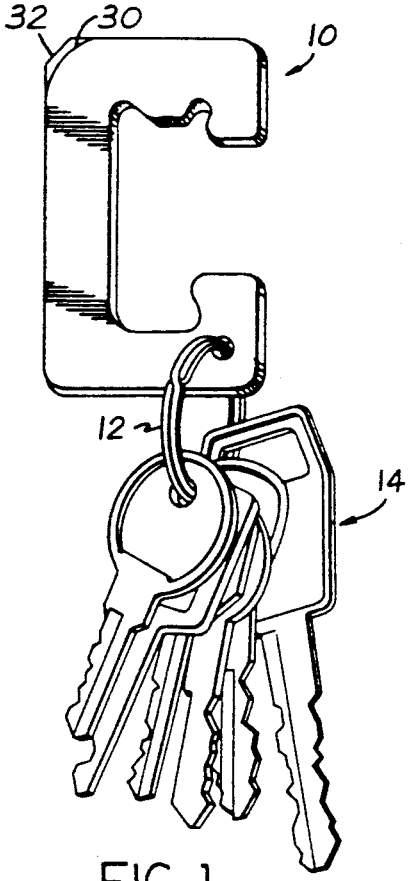
FIG. 1 is a perspective view of the utility device according to the present invention, shown in operation with a key ring and keys.

Referring now to the Drawing, FIG. 1 shows the utility device 10 according to the present invention in operation with respect to a key ring 12 and a set of keys 14 which are trapped on the key ring. The utility device 10 serves in the capacity of an anchor for the key ring 12 so that the keys 14 are easily found in the pocket or purse of the user.

Figure 2:
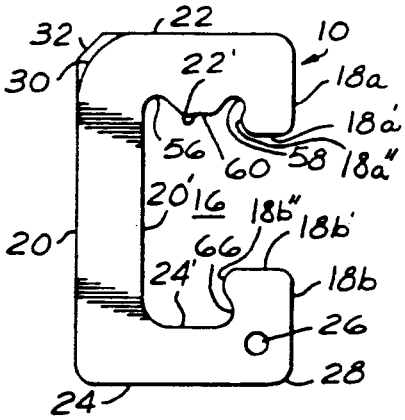
FIG. 2 is a side view of the utility device according to the present invention.
Figure 3:
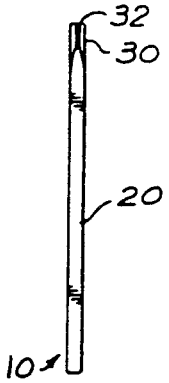
FIG. 3 is an end view of the utility device according to the present invention.

As can be understood by reference now being directed to FIGS. 2 and 3, the utility device 10 is of a general C-shape composed of an upper cross member 22 and a lower cross member 24 that are each integrally connected with a main member 20 at right angles with respect thereto, an upper tab 18*a* that is integrally connected with the upper cross member 22 at a right angle with respect thereto, and a lower tab 18*b* that is integrally connected with lower cross member 24 at a right angle with respect thereto. The general C-shape of the utility device 10 forms a central open space 16 which opens outwardly between the two mutually opposed upper and lower tabs 18*a* and 18*b*, having, respectively, mutually facing ends 18*a'* and 18*b'*. It is preferred for the utility device to be constructed of a single piece of durable plastic, such as polystyrene, or metal (as shown in the Drawing), such as aluminum or stainless steel. In the case of plastic construction, injection molding is preferred, while in the case of metal construction, a blanking operation is preferred.

By way of example, dimensions of the utility device 10 may be generally as follows. Length of the main member 20 is preferred to be 2.35 inches; length of the upper and lower cross members 22, 24 is preferred to be 1.41 inches; and the length of the opening between the ends 18*a'* and 18*b'* is preferred to be 0.91 inches. Width for each of the main member, upper and lower cross members and upper and lower tabs is preferred to be on the order of about one-half inch, but this may vary, especially with respect to the upper and lower tabs. In the case of plastic construction, a thickness for the utility device 10 on the order of 0.25 inches is preferred, while in the case of metallic construction, a thickness on the order of 0.09 to 0.125 inches is preferred, depending on composition of the metal.

A hole 26 is provided in the utility device 10 at a location preferably adjacent lower tab 18*b*, near a corner 28. The hole 26 serves to allow a key ring (key chain and the like) 12 to be connected with respect to the utility device 10.

Figure 8:
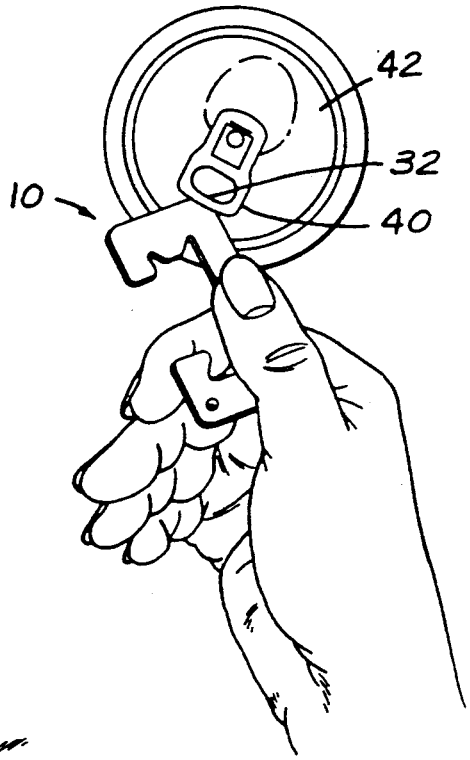
FIG. 8 is a perspective view of the utility device according to the present invention shown in operation with respect to lifting a can tab.
Figure 9:
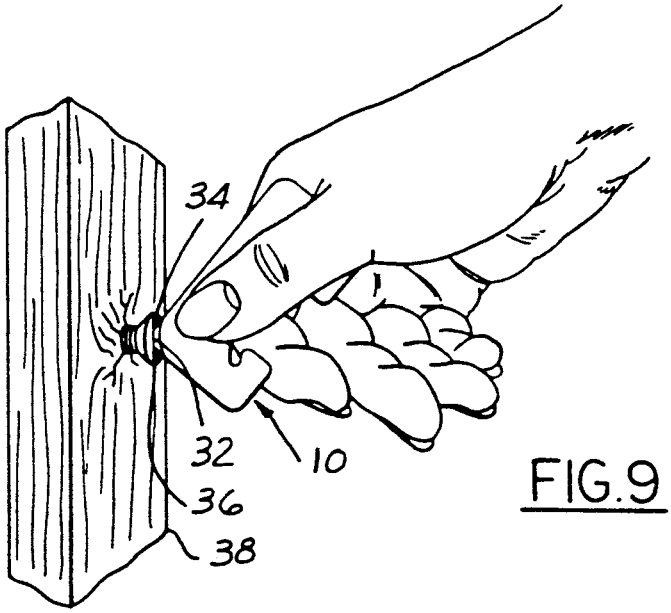
FIG. 9 is a perspective view of the utility device according to the present invention shown in operation with respect to turning a screw.

A corner 30 of the utility device 10 is provided with a locally flat, beveled blade edge 32 of the type used in a conventional screwdriver. As can be discerned by reference to FIG. 9, this blade edge 32 is structured to interface with a screwdriver slot 34 so that, for example, a screw 36 can be turned with respect to a workpiece (such as a wooden block 38) in a manner similar to that made possible by of a conventional screwdriver. It is preferred that the corner 30 having the blade edge 32 be located diagonally opposite the corner 28 that is located adjacent the hole 26, although this is not a requirement. FIG. 8 shows how the blade edge 32 may also serve to lift a can tab 40 by inserting the blade edge between the can tab and the can top 42 so that the user may thereupon lift the can tab in order to thereafter open the can top.

Figure 7:
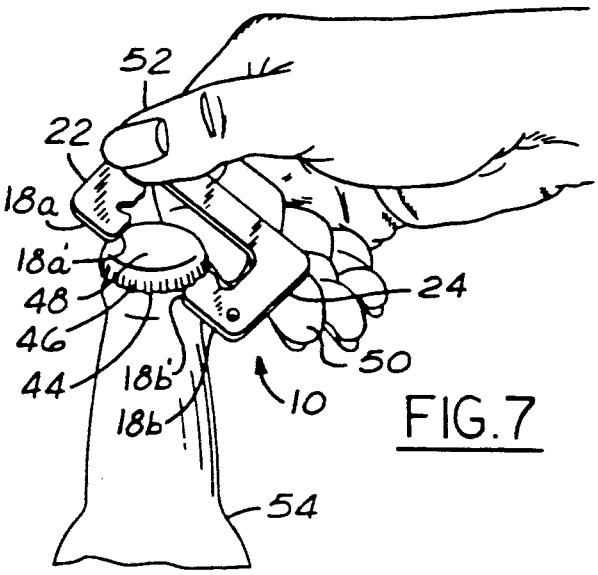
FIG. 7 is a perspective view of the utility device according to the present invention shown in operation with respect to opening a bottle cap.

The distance between the ends 18*a'* and 18*b'* is preselected so that they may cooperate in order to permit a user to open a capped bottle. This structural relationship to function is exemplified in FIG. 7. It will be seen that in operation one end 18*b'* is located just under the rim 44 of a bottle cap 46, while the other end 18*a'* is located at the top 48 of the bottle cap remote from the rim 44 that is adjacent end 18*b'*. An upward pressure by the user's fingers 50 on the lower cross member 24 and downward push by the user's thumb 52 on upper cross member 22 results in a lever action in which the bottle cap 46 is dislodged from the bottle 54 due to the forces transmitted via the ends 18*a'* and 18*b'* to the bottle cap. With regard to plastic construction of the utility device 10, it is preferred for the ends 18*a'* and 18*b'* to be wedge shaped so as to facilitate the above described operation with respect to dislodging the bottle cap.

Figure 4:
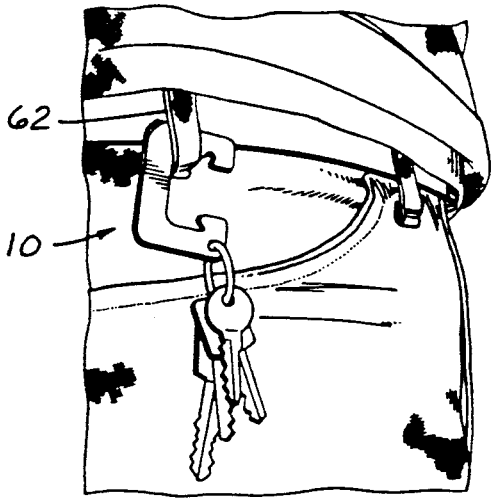
FIG. 4 is a perspective view of the utility device according to the present invention shown in operation with respect to a belt loop.
Figure 5:
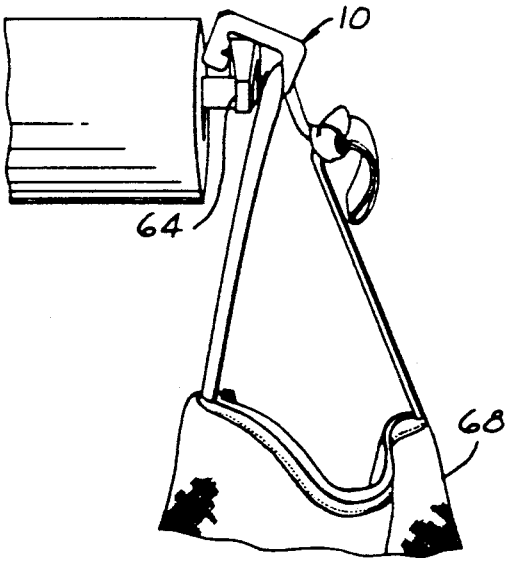
FIG. 5 is a perspective view of the utility device according to the present invention shown in operation with respect to a toilet paper holder and a purse.
Figure 6:
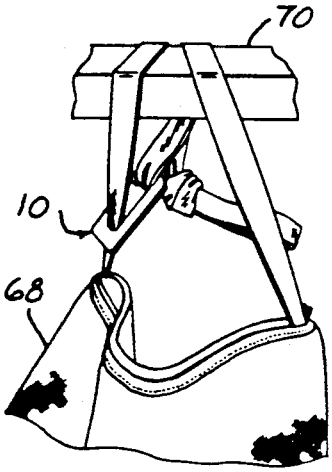
FIG. 6 is a perspective view of the utility device according to the present invention shown in operation with respect to a rail and a purse.

Still a further utility of the utility device 10 is to serve as a hook for hooking onto an object and, further, for hooking yet another object onto itself. FIGS. 4 through 6 depict this utility.

As can be discerned by reference to FIG. 2, it will be seen that the inside wall 22' of the upper cross member 22 is at least in part provided with first and second concavely shaped indentations 56, 58 positioned on either side of a central ridge 60. The first concavely shaped indentation 56 may also be partly located in the inside wall 20' of the main member 20, and the second concavely shaped indentation 58 may be partly located in the inside wall 18*a''* of the upper tab 18*a*. Each of the concavely shaped indentations 56, 58 serve to facilitate hooking of the utility device 10 onto an object. For instance, FIGS. 4 and 5 show this operatively with respect to objects in the form of a belt loop 62, and a fixture 64 (in this case a bathroom tissue dispenser). It will be noted that the object tends to nestle with respect to at least one of the concavely shaped indentations to securely hook the utility device 10 with respect to the object. Further, a third concavely shaped indentation 66 is preferred to be at least in part provided in the inside wall 18*b''* of the tab 18*b* located adjacent lower cross memeber 24. The third concavely shaped indentation may also be partly located in the inside wall 24' of the lower cross member 24. As depicted in FIGS. 5 and 6 the concavely shaped indentations 56, 58 and 66 serve as an aid to hold not only the utility device to a first object, such as a fixture 64, but also to hold a second object, such as a purse 68 via its straps. Thusly, the utility device 10 serves to releaseably connect a second object (such as a purse 68) to a first object (such as a fixture 64 or a rail 70). With respect to plastic construction of the utility device 10, the aforementioned preferred wedge shaped ends 18*a'* and 18*b'* facilitate hooking of the utility device to an object.

In any mode of operation of the utility device 10, a key ring with or without keys may be connected to the utility device via the hole 26.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A utility device for use in connection with a key chain and the like, said utility device comprising:

a main member having a first end and a second end;

an upper cross member having a first end and a second end, said first end thereof being integrally connected at a substantially right angle with respect to said first end of said main member;

a lower cross member having a first end and a second end, said first end thereof being integrally connected at a substantially right angle with respect to said second end of said main member;

an upper tab having a first end and a second end, said first end thereof being integrally connected at a substantially right angle with respect to said second end of said upper cross member; and a lower tab having a first end and a second end, said first end thereof being integrally connected at a substantially right angle with respect to said second end of said lower cross member;

wherein at least one of said main member, said upper cross member, said lower cross member, said upper tab and said lower tab has a hole for interconnecting the key chain and the like to said utility device; wherein further, said main member, said upper cross member, said lower cross member, said upper tab and said lower tab collectively form a substantially C-shaped structure formed about a central open space that includes an opening defined by said second end of said upper tab being separated from and mutually facing toward said second end of said lower tab.

2. The utility device of claim 1, wherein said upper cross member has a first interior wall adjacent said central open space, said first interior wall having at least in part of first concavely shaped indentation at a location substantially adjacent said main member.

3. The utility device of claim 2, wherein said main member has a second interior wall adjacent said central open space; wherein said first concavely shaped indentation is in part located in said second interior wall.

4. The utility device of claim 2, wherein said first interior wall further has at least in part a second concavely shaped indentation at a location substantially adjacent said upper tab member.

5. The utility device of claim 4, wherein said upper tab has a third interior wall adjacent said central open space; wherein said second concavely shaped indentation is in part located in said third interior wall.

6. The utility device of claim 2, wherein said lower tab has a fourth interior wall adjacent said central open space, said fourth interior wall having at least in part a third concavely shaped indentation at a location substantially adjacent said lower cross member.

7. The utility device of claim 6, wherein said lower cross member has a fifth interior wall adjacent said central open space, wherein said third concavely shaped indentation is in part located in said fifth interior wall.

8. The utility device of claim 6, wherein said main member, said upper cross member, said lower cross member, said upper tab and said lower tab mutually interconnect to form four exterior corners, wherein further at least one exterior corner thereof has screwdriver blade means integral therewith for engaging and selectively turning an object having a screwdriver slot.

9. The utility device of claim 8, wherein said second end of said upper tab is separated from said second end of said lower tab a predetermined distance which enables each said second end of said upper and lower tab to engage a bottle cap on a capped bottle so that a user is able to leverably dislodge the bottle cap from the bottle by applying a first force on a rim of the bottle cap with the second end of one of said upper and lower tabs while simultaneously applying a second force on a selected location on top of the bottle cap with the second end of the other of said upper and lower tabs.

10. The utility device of claim 1, wherein said main member, said upper cross member, said lower cross member, said upper tab and said lower tab mutually interconnect to form four exterior corners, wherein further at least one exterior corner thereof has screwdriver blade means integral therewith for engaging and selectively turning an object having a screwdriver slot.

11. The utility device of claim 1, wherein said second end of said upper tab is separated from said second end of lower tab a predetermined distance which enables each said second end of said upper and lower tab to engage a bottle cap on a capped bottle so that a user is able to leverably dislodge the bottle cap from the bottle by applying a first force on a rim of the bottle cap with the second end of one of said upper and lower tabs while simultaneously applying a second force on a selected location on top of the bottle cap with the second end of the other of said upper and lower tabs.

12. The utility device of claim 4, wherein said lower tab has a fourth interior wall adjacent said central open space, said fourth interior wall having at least in part a third concavely shaped indentation at a location substantially adjacent said lower cross member.

13. The utility device of claim 12, wherein said lower cross member has a fifth interior wall adjacent said central open space, wherein said third concavely shaped indentation is in part located in said fifth interior wall.

14. The utility device of claim 12, wherein said main member, said upper cross member, said lower cross member, said upper tab and said lower tab mutually interconnect to form four exterior corners, wherein further at least one exterior corner thereof has screwdriver blade means integral therewith for engaging and selectively turning an object having a screwdriver slot.

15. The utility device of claim 14, wherein said second end of said upper tab is separated from said second end of said lower tab a predetermined distance which enables each said second end of said upper and lower tab to engage a bottle cap on a capped bottle so that a user is able to leverably dislodge the bottle cap from the bottle by applying a first force on a rim of the bottle cap with the second end of one of said upper and lower tabs while simultaneously applying a second force on a selected location on top of the bottle cap with the second end of the other of said upper and lower tabs.

* * * * *